US006516920B1

(12) United States Patent
Schafler

(10) Patent No.: US 6,516,920 B1
(45) Date of Patent: Feb. 11, 2003

(54) TAG LINE PACK

(76) Inventor: Karl M. Schafler, 5 E. Hilburn, Bellville, TX (US) 77418

( * ) Notice: Subject to any disclaimer, the term of this patent is extended or adjusted under 35 U.S.C. 154(b) by 0 days.

(21) Appl. No.: 09/692,946

(22) Filed: Oct. 20, 2000

Related U.S. Application Data

(60) Provisional application No. 60/160,774, filed on Oct. 21, 1999.

(51) Int. Cl.[7] ..... A62B 1/06
(52) U.S. Cl. ..... 182/70; 182/190
(58) Field of Search ..... 182/70, 18, 190, 182/5, 192; 116/205; 206/388, 409

(56) References Cited

U.S. PATENT DOCUMENTS

| | | | | |
|---|---|---|---|---|
| 3,419,236 | A | | 12/1968 | Weber |
| 3,586,257 | A | | 6/1971 | Zelinskas |
| 3,676,882 | A | * | 7/1972 | Lindquist |
| 4,102,431 | A | | 7/1978 | Carroll et al. |
| 4,527,504 | A | | 7/1985 | Byerley |
| 4,662,517 | A | | 5/1987 | Wirth |
| 4,844,000 | A | | 7/1989 | Clement |
| 4,877,110 | A | | 10/1989 | Wolner |
| 4,932,574 | A | | 6/1990 | Doshi |
| 4,949,401 | A | | 8/1990 | Kimsey, Jr. |
| 5,027,741 | A | | 7/1991 | Smith et al. |
| 5,042,613 | A | | 8/1991 | Hermann |
| 5,868,219 | A | | 2/1999 | Sadeck et al. |

FOREIGN PATENT DOCUMENTS

| | | |
|---|---|---|
| FR | 859964 | 1/1941 |

* cited by examiner

*Primary Examiner*—Alvin Chin-Shue
(74) *Attorney, Agent, or Firm*—Gary L. Bush; Andrews & Kurth, LLP

(57) ABSTRACT

A safety device for firefighters or rescue personnel including a container or bag 10 having a pack of safety line 12 therein formed from flat fabric webbing folded into a plurality of accordion folds or laps and deployed from a lower end of the bag 10. One embodiment (FIGS. 1–3) is hand carried, while another embodiment (FIGS. 4–5) is secured to the body of the firefighter.

3 Claims, 2 Drawing Sheets

FIG. 1
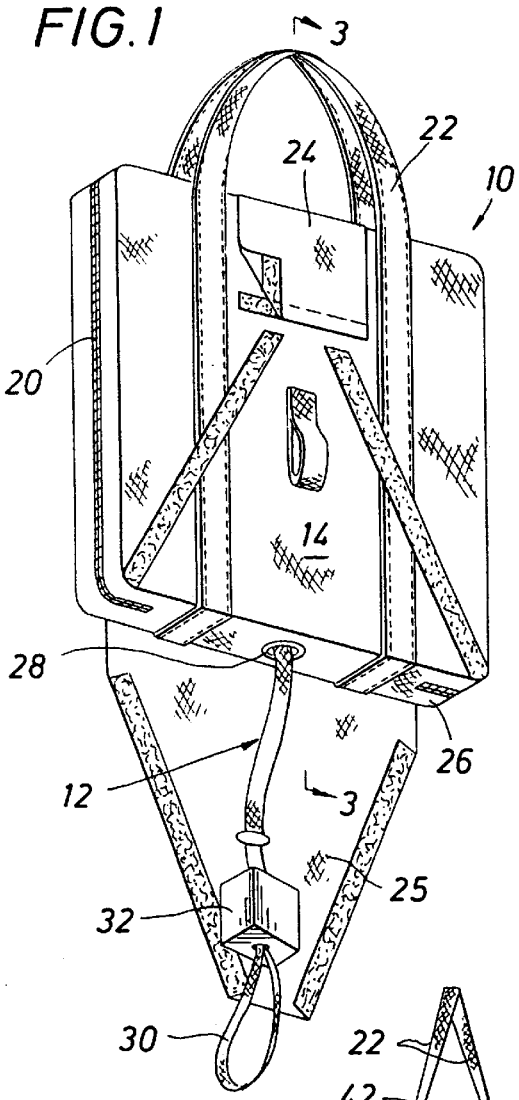
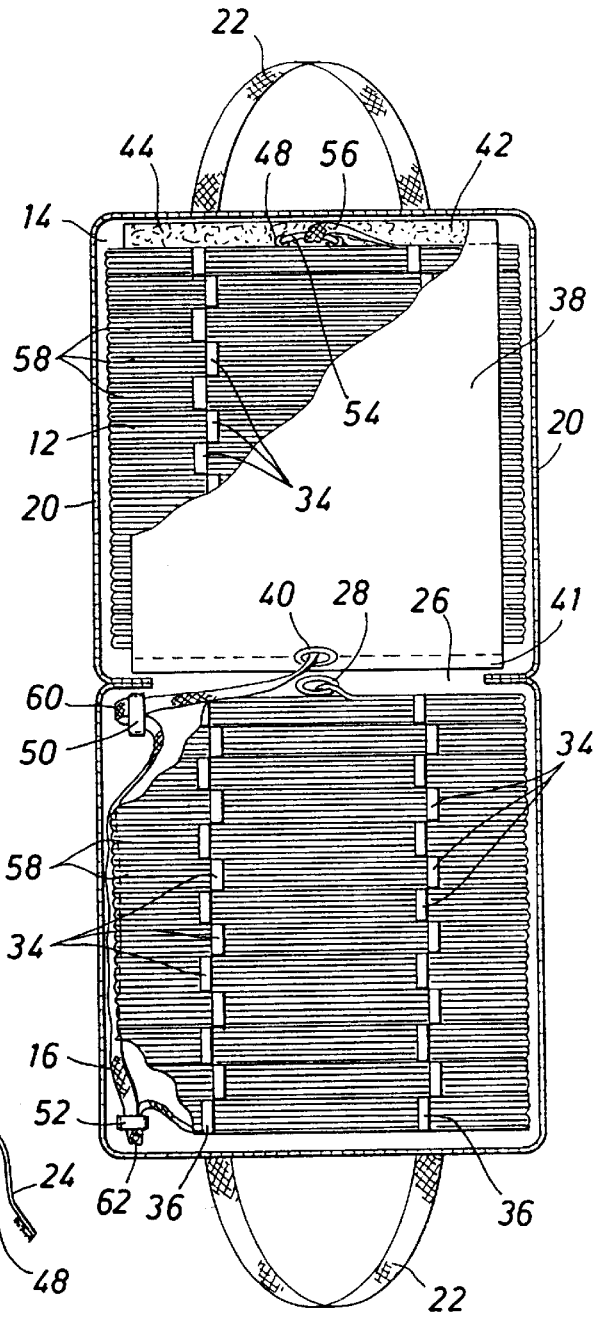
FIG. 2
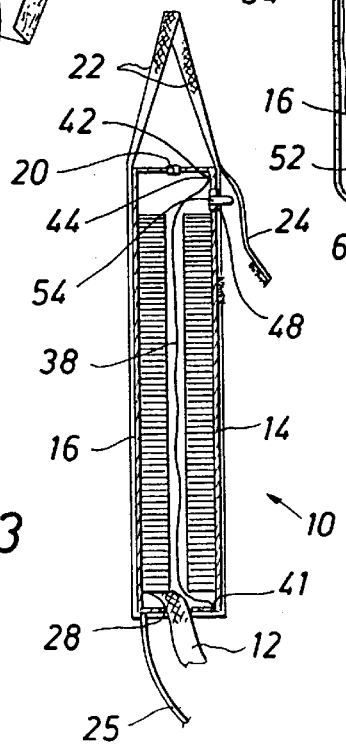
FIG. 3

TAG LINE PACK

CROSS REFERENCE TO RELATED APPLICATION

This application claims priority from provisional application 60/160,774 filed on Oct. 21, 1999.

BACKGROUND OF THE INVENTION

1. Field of the Invention

This invention relates to a safety line system for emergency personnel, such as firefighters. Such a safety line is called a "TagLine" by firefighters. More particularly, the invention concerns a deployment container or bag or pack having a safety line disposed in it which may be fed out from an anchored free end of the safety line while being carried into a smoke-filled building by a fireman so that the fireman may be guided by the safety line under conditions of darkness and dense smoke in returning to the anchored end thereof.

2. Description of Prior Art

In numerous fire fighting situations a firefighter or other emergency rescue personnel, such as medical personnel, often need to enter a burning structure to search for victims in different areas. The structures are often filled with thick, dense smoke, and it is very difficult for the firefighter to see through the smoke. Such conditions are very dangerous for the firefighter when he or she attempts to find the way out, because the firefighter can easily become disoriented or lost in the thick smoke. Fire department regulations often require that the firefighter carry a safety line to assist in finding the way out.

Heretofore, it has been common for a firefighter to have a safety line or tag line attached to him at one end with the other end fed out to him from a safe point of a smoke-filled building. The firefighter could then return to the point of entry by following the safety line. Oftentimes, however, such a safety line is not used, because such a line has not been easy to deploy or carry.

Other types of lines are used by a firefighter for the safe descent from a higher place to a lower place or for effectively preventing people from falling from dangerous heights. Such lines are also designed to be heavy and strong so that they can support a person's full body weight. However, in many cases when a firefighter is working where these types of height related safety devices are not necessary, such lines are too heavy and time consuming to operate. The primary purpose of having a safety or tag line attached to a firefighter on any level within a structure is to provide a guideline to find the way back or to permit others to find the firefighter in case the smoke is too thick for visibility.

U.S. Pat. No. 5,042,613 dated Aug. 27, 1991 is directed to a safety tracer or line for firefighters in which a reel or housing for a coiled cord is clipped to a belt of the firefighter with the free end of the cord anchored to a door or the like of a burning house or building. When the firefighter enters a room to be searched, the end of the cord may be anchored to the door and the cord unreeled upon walking or movement of the firefighter away from the door. The cord may be used as a guide for the firefighter to find the door in the event of thick smoke or the like.

IDENTIFICATION OF OBJECTS OF THE INVENTION

An object of this invention is to provide a container or bag for a safety guideline carried by a firefighter so that the guideline may be easily folded into a pack fitting within the bag and then without becoming tangled easily pulled or fed out from an opening in the bag upon anchoring of the free end of the line to a door or the like of a burning structure.

Another object of this invention is to provide a safety guideline for firefighters which is folded into a pack with an end extending therefrom and where the end is anchored to a door or the like and the pack is carried by the firefighter into a room of a smoke-filled building while the line extends out of the bag to guide the firefighter to the point from which he/she entered the building or to guide others to the firefighter in the even the firefighter needs help or is in trouble.

SUMMARY OF THE INVENTION

The invention is directed to a safety line deployment system including a container or bag which may be hand carried by a firefighter in one embodiment or may be secured, such as by strapping onto the body of the firefighter, in another embodiment. While the invention may be used particularly by firefighters, it is to be understood that the term "firefighter" as used herein includes other rescue personnel, who may be searching for persons trapped within a smoke-filled building. A safety guideline, preferably formed of a flat fabric such as webbing material, is folded into a pack fitting in the container. A free end of the safety line extends from the container and is secured to an anchoring means, such as a hook to be fastened to a railing or the like, or a block which may be thrown over or under an open door with the safety guideline passing in the space between the door and door frame. Upon entering a structure to be searched through an open door, the free end of the guideline is anchored, and as the firefighter walks into the structure, the safety line is pulled from the container by the anchored free end.

One embodiment of the container comprises a fabric bag manually carried by the firefighter with the upper end having carrying straps and the lower end or bottom having an opening therethrough for feeding out the safety line packed within the bag. A pack of folded fabric webbing material forming the safety guideline is positioned between zippered sides of the bag. A free end of the safety line extends through the bottom opening for pulling out the guideline after the free end is anchored.

Another embodiment of the container comprises a bag which may be mounted or secured to the body of the firefighter by an upper belt loop and a lower strap about the leg of a firefighter much like a western holster. The outer portion of the bag includes flaps folded over a pack of the fabric webbing forming the safety guideline. The flaps have hook and loop fastener (VELCRO) strips therein, and the flaps are releasably connected to each other over the folded guideline pack. Rather than strapping such bag to the firefighter's leg, such bag may be directly fastened (e.g. be sewing) to the pants leg or coat of the firefighter.

BRIEF DESCRIPTION OF THE DRAWINGS

The objects, advantages and features of the invention will become more apparent by reference to the drawings which are appended hereto and wherein like numerals indicate like parts and wherein illustrative embodiments of the invention are shown, of which:

FIG. 1 is a perspective of one embodiment of this invention in which the container comprises a bag which may be manually carried by a firefighter, with the bag containing packs of folded safety line therein for being pulled out from the bottom of the bag upon anchoring of a free end of the line;

FIG. 2 is a top plan of the bag of FIG. 1 shown in an open position with packs of the folded safety line releasably secured within the bag by hook and loop fastener (VELCRO) strips;

FIG. 3 is a section taken generally along line 3—3 of FIG. 1 which shows a divider between two connected packs of safety line;

DESCRIPTION OF THE INVENTION

Figure 4:
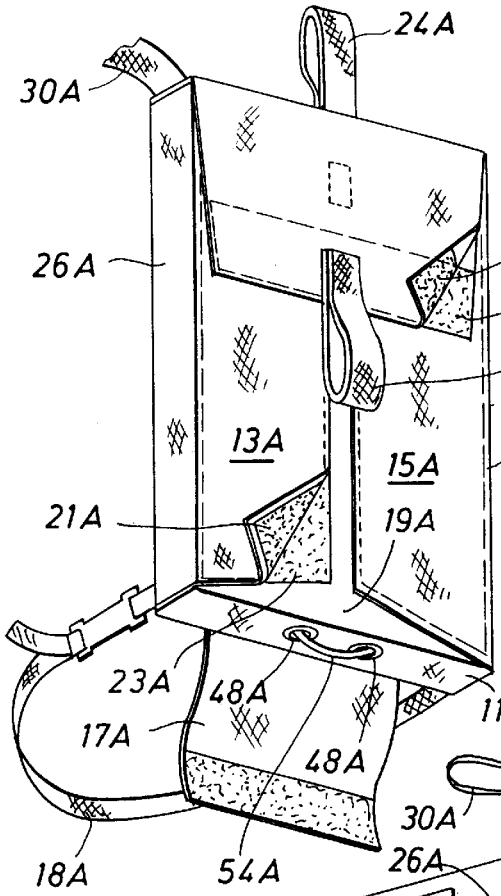
FIG. 4 is a perspective of an alternative smaller embodiment of the invention in which the container comprises a bag for mounting on the body of a firefighter by a strap for securement about the firefighter's leg.

Referring now to the drawings for a better understanding of the invention, and more particularly to the embodiment shown in FIGS. 1–3, the container or bag generally indicated at 10 is a fabric bag to store a safety tag line or guideline shown generally at 12 therein. Bag 10 includes sides 14 and 16 to form a handle for manual gripping by a firefighter. A small flap 24 is connected to side 14 to cover two grommet holes used to secure a locking oval ring 54 used to secure the free end 56. The bottom 26 of bag 10 has a metal grommet 28 therein defining a bottom opening which receives guideline 12. Sides 14 and 16, when unzipped unfold to an open position as shown in FIG. 2.

Guideline 12 has a loop 30 at its free end which is provided to receive a snap hook or fit over a projection, such as a post, for anchoring the free end of guideline 12. Also, to be used in lieu of loop 30 for anchoring line 12, a door stop block 32 is provided which may be thrown over a hinged open door in the space between the door and door frame to be blocked by the door, thereby to anchor the free end of line 12.

It is important that guideline 12 be packed within bag 10 so that it does not become tangled or twisted as it is being deployed or fed out of bag 10. Guideline 12 is preferably a flat nylon webbing having a width of about one (1) inch and is folded accordion style in folds or laps. For securement of guideline 12 within bag 10, a plurality of ties shown at 34 are provided, each tie 34 including a pair of spaced retaining hook and loop fastener (VELCRO) tabs 36 which are secured to sides 14, 16. The tabs 36 are arranged and designed to be folded over a predetermined number of accordion folds, such as 8 or 10 folds, for example, with the overlapping ends of tabs 36 pressed together for securement over the accordion folds to position guideline 12 for deployment from bag 10.

Side 14 has a divider 38 secured at its lower edge 41 to side 14. A hook and loop fastener (VELCRO) strip 42 along the upper edge of divider 38 is pressed against hook and loop fastener (VELCRO) strip 44 on side 14 which fastens divider 38 to side 14. A metal grommet 40 in divider 38 adjacent to lower edge 41 defines an opening to receive guideline 12. Lower and upper elastic loops 52, 50 are secured to side 16 in order to secure a middle portion of guideline 12 along an edge of side 16.

For packing of guideline 12 within bag 10, a clamp or snap hook 54 in a side 14 extending through an end loop 56 on line 12 to releasably secure an end of line 12 to side 14 of the bag 10. The flat nylon webbing of line 12 is then folded tightly into accordion fold sections 58 with each section consisting of about 8–10 folds or laps fitting within a pair of hook and loop fastener (VELCRO) retaining ties 34 which are pressed together over an accordion fold section 58. Sections 58 are formed and secured in sequence from end loop 56 to lower edge 40 of divider 38 thereby to complete one pack of line 12. Next, the divider 38 is installed as illustrated in FIG. 2.

The free end of line 12 is passed through grommet 40 of divider 38 and then a small loop or bend 60 is formed in line 12 and passed under elastic loop 50 for securement of bend 60. Next, a small bend or loop 62 in line 12 is passed under elastic loop 52 for securement of bend 62. Now, accordion fold sections 58 are formed and secured by hook and loop fastener (VELCRO) ties 34 on side 16 in the same manner as the first pack adjacent side 14 until line 12 reaches bottom 26 where it passes through a metal grommet 28 to outside of bag 12. Then, the free end of line 12 is passed through central bore in door stop block 32 and end loop 30 formed to retain stop block 32 and to form a separate retainer for anchoring the free end of guideline 12. A snap hook (not shown) may be attached to loop 30 to anchor line 12 to a railing, for example. Sides 14 and 16 may then be closed over the packs 12 of line 12 and zipper 20 zippered to secure sides 14, 16 as shown in FIG. 1 in which position the bag 10 is ready for deployment. A total length of guideline 12 of around 200 feet may be provided with each side of packs being around 100 feet in length. A large flap 25 attached to side 26 is provided which is large enough to cover the end of the line 12, the stop block 32, and the loop 30 which exit from grommet 28 and to be secured to side 14 by means of hook and loop fastener (VELCRO) strips. Flap 25 helps to prevent damage to guideline 12 when the pack 10 is not in use.

In operation, with bag 10 as shown in FIG. 1 is carried by a firefighter or emergency person gripping hand straps 22 and entering a burning building to conduct a search, door stop block 32 is thrown over or under an open door in the space between the door and door frame with the door blocking movement of block 32 thereby forming an anchor for guideline 12. Guideline 12 is pulled from the bag 10 via metal grommet 28 in sequence from the lower end of side 16 to the upper side thereof with folds or laps of the guideline slipping from ties 34. Next, line 12 is pulled from elastic loops 52, 51 and then pulled from metal grommet 40 in divider 38 for being deployed from side 14 until the end of line 12 is reached at locking oval ring 54. Thus, line 12 is effectively deployed from container or bag 10 in a uniform efficient manner without any tangling or twisting of line 12 as it is being deployed. Line 12 may be utilized for guiding another person in a rescue operation to the person carrying line 12 as well as guiding the person with line 12 to the anchored end of line 12 in a return direction. Another line 12 of another bag 10 can be secured to snap hook 54 to extend the tag line by a firefighter.

Figure 5:
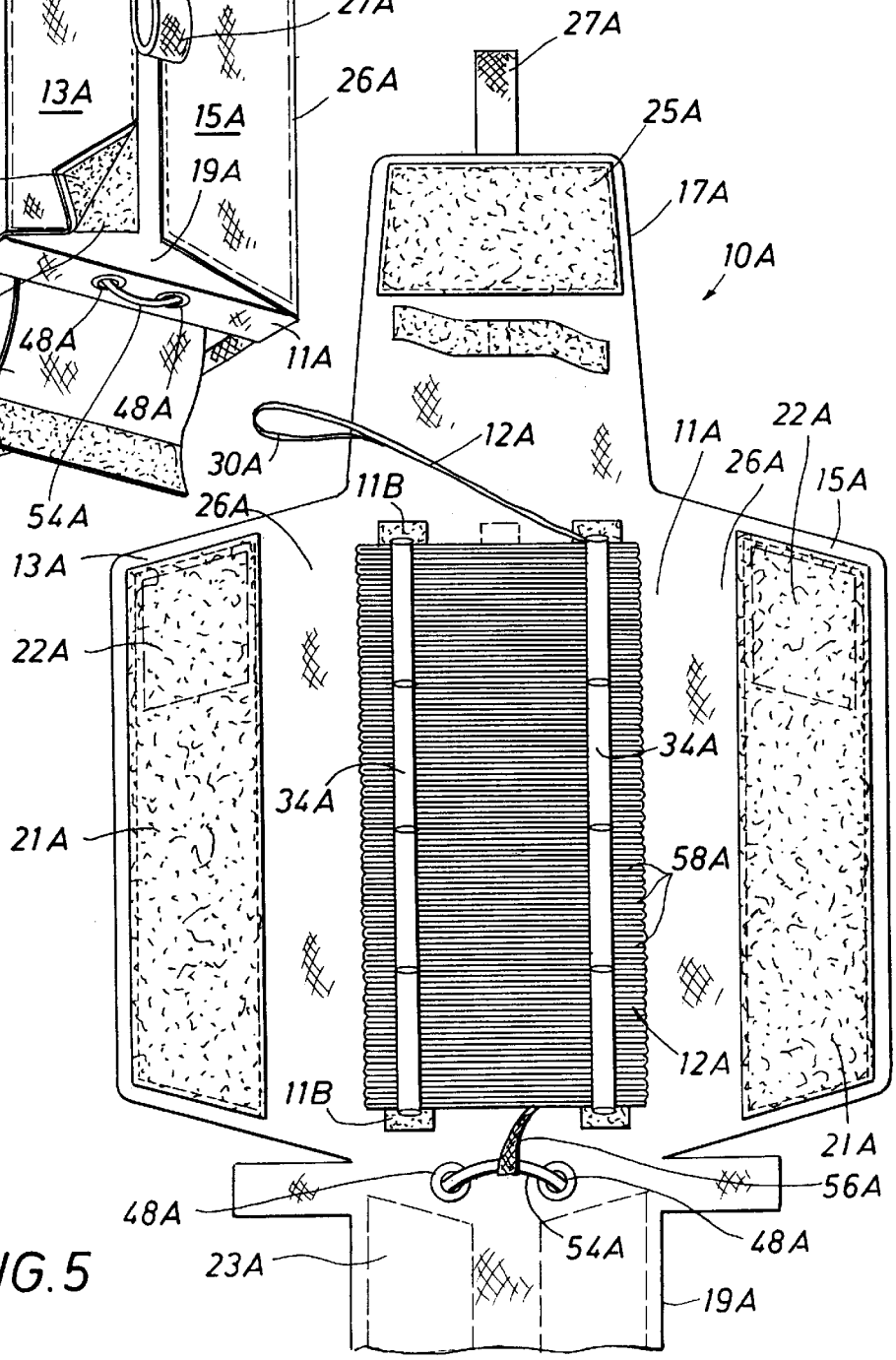
FIG. 5 is a plan view of the embodiment of FIG. 4 showing flaps of the bag in an open position for folding about a pack of safety guideline.

Referring now to FIGS. 4 and 5, an alternative embodiment of the invention is illustrated for fastening to the body of the firefighter. The container or bag 10A has a loop 24A which is arranged and designed to receive a snap hook or a belt or the like extending about the body of the firefighter. An adjustable leg strap 18A is provided to fit about a leg of the firefighter with bag 10A fitting against the hips or thigh of the firefighter. Bag 10A includes a back or base panel 11A, foldable side flaps 13A, 15A, and foldable end flaps 17A, and 19A. hook and loop fastener (VELCRO) strips 21A are secured on one side of side flaps 13A and 15A and Velcro strips 22A are secured to an opposite side. Hook and loop fastener (VELCRO) strips 23A are secured to end flap 19A and hook and loop fastener (VELCRO) patch 25A is secured to end flap 17A. For securing flaps 13A, 15A, 17A, and 19A over a pack of line 12A from the position of FIG. 5, end flap 19A is first folded over the packed guideline shown generally at 12A with hook and loop fastener (VELCRO) straps 23A facing outwardly. Then, side flaps 13A and 15A are folded over end flap 19A with hook and loop fastener (VELCRO) strips 21A pressed against hook and loop fastener (VELCRO) strips 23A. Then, upper flap 17A is folded downwardly onto side flaps 13A, 15A with hook and loop fastener (VELCRO) patch 17A pressed against hook and loop fastener (VELCRO) strips 22A.

Guideline 12A is similar to guideline 12 in the embodiment of FIGS. 1–3; the pack of accordion folds or laps of guideline 12A is similar to the packs of FIG. 1–3. A loop 56A on one end of line 12A is secured to a releasable fastener 54A mounted on a loop 48A secured to base panel 11A. Accordion folds or laps 58A of guideline 12A are secured by elastic strapping 34A. Such ties 34A are secured to a region of increased thickness or backing 11B fixed to base panel 11A. The free end of guideline 12A, shown partially at 30A, includes a loop but no doorstop block as in the embodiment of FIGS. 1–3. A loop shown at 27A secured to flap 17A is provided as a hand tab to releasably secure the free end 30A of guideline 12A. Guideline 12A may, for example, be of a length of fifty (50) feet. A flap 17A is also secured to base panel 11A for folding over ring 54 and end 56A of line 12A.

In operation, with bag 10A secured to the body of a firefighter entering a burning building, line end 30A is anchored to the building or to an end of a deployed guideline 12 (for example like that of FIGS. 1–3) and the line 12A is deployed from the top of bag 10A adjacent flaps 13A and 19A in sequence from the top side of the packed guideline 12A to the bottom side thereof adjacent end loop 56A.

While the embodiment of FIGS. 5 and 6 has been shown as releasably secured to the body of a firefighter, it may be desirable in some instances to have the bag sewn directly onto a garment, such as pants or coat, worn by the firefighter. The present invention provides a durable, highly visible, and efficient tag line assembly for a safety line which may be deployed as a guideline or rescue line for persons within a burning building and by virtue of the locking oval ring 54*a* secured to lower end of bag and to line 12*a*, the useful length of line 12*a* may be increased.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A safety line assembly comprising:

a back panel (14, 11A) having a fastener (54, 54A) secured thereto, a first end (56, 56A) of a safety line (12, 12A) attached to said fastener (54, 54A), with said safety line (12, 12A) releasably secured to said back panel (14, 11A) in laps (58, 58A) which extend to a second end (12, 12A), said safety line having a predetermined length, at least one enclosing member (16, 13A, 15A) attached to said back panel (14, 11A) from an attachment area (26, 26A), said enclosing member arranged and designed to fold from said attachment area to form an enclosure about said safety line, said fastener with said first end of said safety line, being disposed at a first end of said enclosure, said second end of said safety line extending outwardly from a second end of said enclosure, and a device secured to said second end of safety line for securing said line to a stationary object, whereby after said second end of said safety line is secured to said stationary object, movement of said enclosure by a human being causes said safety line to be pulled from said enclosure until said predetermined length of said safety line is completely pulled from said first enclosure whereupon said first end of said safety line pulls directly on said fastener (54, 54A), a divider sheet having first and second ends with said first end of said divider secured to said first end of said back panel and with said divider sheet positioned to substantially cover said laps which are secured to said back panel, said second end of said divider having a divider grommet (40) through which safety line extends, said enclosing member including a front panel (16), which extends outwardly from said back panel from said attachment area (26), said safety line extending from said divider grommet (40) along a side edge of said front panel (16) to an upper end of said front panel while being releasably secured thereto, which is opposite said attachment area (26), said safety line releasably secured to said front panel in laps which extend to said attachment area, said second end of said safety line extending outwardly of said enclosure from a grommet at said attachment area.

2. The assembly of claim 1 wherein, said front panel is releasably secured to said back panel by a closure device, with said divider separating said safety line laps of said back panel from said safety line laps of said front panel.

3. The assembly of claim 2 wherein, said closure device is a zipper which runs along the edges of said back panel and said front panel from said attachment area.

* * * * *